United States Patent [19]

Schuller et al.

[11] Patent Number: 4,759,294

[45] Date of Patent: Jul. 26, 1988

[54] RAILROAD CAR WITH DOUBLE STACK CONTAINER RESTRAINT SYSTEM

[75] Inventors: James J. Schuller, Crete, Ill.; John A. Ritter, Cincinnati, Ohio

[73] Assignee: Thrall Car Manufacturing Company, Chicago Heights, Ill.

[21] Appl. No.: 74,622

[22] Filed: Jul. 17, 1987

[51] Int. Cl.[4] ..... B61D 3/20; B61B 45/00

[52] U.S. Cl. ..... 105/355; 410/54; 410/71

[58] Field of Search ..... 105/355, 393, 404; 410/44, 54, 71, 72, 77, 78, 80, 84, 121

[56] References Cited

U.S. PATENT DOCUMENTS

| | | | |
|---|---|---|---|
| 2,914,204 | 11/1959 | Groll | 105/355 |
| 3,570,411 | 3/1971 | Adler et al. | 410/78 |
| 4,624,188 | 11/1986 | Kaleta | 105/355 |

*Primary Examiner*—Carlton R. Croyle
*Assistant Examiner*—Leonard P. Walnoha
*Attorney, Agent, or Firm*—Marshall, O'Toole, Gerstein, Murray & Bicknell

[57] ABSTRACT

A railroad car for transporting double stacked shipping containers capable of supporting top containers of at least two different lengths against longitudinal and lateral movement comprising a car which supports a lower container, each end of the car body having a bulkhead structure which includes a lateral end wall and a pair of side walls extending longitudinally inwardly from the end wall, each side wall of a pair of such walls having a container restraining member mounted for rotation about a vertical axis from a stored position where it does not reduce the clearance between opposing side walls to an operating position where it at least projects laterally inwardly of the side wall to be positioned adjacent a vertical end corner of a top container, a rotatable shaft extending laterally across the car body and having a handle at each end for manual rotation of the shaft from about track grade, and drive means interconnecting the shaft and a container restraining member on each side wall whereby rotation of the shaft in one direction causes the restraining members to rotate in opposite directions from stored to operating position and rotation of the shaft in the opposite direction causes the restraining members to rotate in opposite directions from operating to stored position.

8 Claims, 4 Drawing Sheets

RAILROAD CAR WITH DOUBLE STACK CONTAINER RESTRAINT SYSTEM

This invention relates to freight cars. More particularly, this invention is concerned with railroad freight cars which transport double stacked containers and mechanisms for removably securing containers of different lengths.

BACKGROUND OF THE INVENTION

Freight containers are widely used to transport a variety of goods and products on ships, barges, railroads and over-the-highway vehicles. Container transport is very efficient since it minimizes labor costs, damage to goods and products and reduces the opportunities for pilferage and vandalism.

Containers come in different but standardized lengths. The lengths most widely used are 20, 35, 40, 45 and 48 feet. To the extent possible, the railroad cars which transport containers must be able to accommodate as many different length containers as possible.

One type of container car in use is referred to as a well car since it contains a container receiving well space between the car railway trucks at each end. The bottom of the well is generally at about the height of the wheel axles so that when one or more containers are placed in the well they provide a low profile and a low center of gravity. This makes it possible to stack one or more containers on top to form a double stack container load. When containers are double stacked, the total length of the top layer can be the same as or considerably longer than the first layer because the top layer can extend over the ends of the well and partially over the trucks.

Regardless of the length of the top container it is desirable to stabilize it against lateral and longitudinal movement during transport. One of the recognized ways of stabilizing the top containers is by means of bulkheads at the end of the cars. The bulkheads have an end wall and opposing side walls. The bulkhead end walls stabilize the longest top container, presently 48 feet, against longitudinal movement and the side walls stabilize it against lateral movement. When shorter containers, such as forty and forty-five feet containers, are on top of a lower forty-feet container or two twenty-feet containers end to end, each of the four container-corner engaging restraining members located on the bulkhead side walls are moved from stored position to operating position so as to engage the vertical corners of the top container. Such a bulkhead well car with container restraining members is disclosed in Kaleta U.S. Pat. No. 4,624,188.

As is clear from the Kaleta U.S. Pat. No. 4,624,188, each of the four container-corner restraining members is manipulated manually from stored to operative position and vice versa. Such manual manipulation requires that a laborer stand adjacent the car side where each restraining member is located. Since each car side has four restraining members, the laborer must move from one side of the car to the other side or two laborers must be used simultaneously with one laborer on each side of the car. This involves undesirable labor cost and danger since movement from one car side to the other may require climbing over the car. A need accordingly exists for a system which will permit all of the restraining members to be moved manually from either side of the car to speed container loading with increased safety and less labor.

SUMMARY OF THE INVENTION

According to the invention, there is provided a railroad car for transporting horizontal double stacked shipping containers capable of supporting top containers of at least two different lengths against longitudinal and lateral movement comprising first and second railroad trucks supporting opposite ends of a railroad car body; the car body having means which supports one or more horizontal longitudinally positioned lower containers; each end of the car body having a vertically projecting bulkhead structure which includes a lateral bulkhead end wall extending the width of the car body and a pair of opposing relatively short bulkhead side walls extending longitudinally inwardly from the bulkhead end wall along the sides of the car body; each bulkhead side wall of a pair of such walls having a container restraining member mounted on an axle for rotation about a substantially vertical axis from a stored position where it does not reduce the clearance between opposing bulkhead side walls to an operating position where it at least projects laterally inwardly of the bulkhead wall to be positioned adjacent a vertical end corner of a top container; a rotatable shaft means extending laterally across the car body and having a handle at each end for manual rotation of the shaft means from about track grade; and drive means interconnecting the shaft means and a container restraining member on each bulkhead side wall whereby rotation of the shaft means in one direction causes the restraining members to rotate in opposite directions from stored to operating position and rotation of the shaft means in the opposite direction causes the restraining members to rotate in opposite directions from operating to stored position.

More specifically, the railroad car can have the rotatable shaft means extending laterally across the car body and having a handle at each end for manual rotation of the shaft means from about track grade; an upwardly extending rod; means operatively interlocking the upwardly extending rod and the shaft means adjacent each bulkhead side wall; and means operatively interlocking the upwardly extending rod and a container restraining member; whereby rotation of the shaft means in one direction causes the restraining members to rotate in opposite directions from stored to operating position and rotation of the shaft means in the opposite direction causes the restraining members to rotate in opposite directions from operating to stored position.

The upwardly extending rod can be pivotally connected at the lower end to a lever on the shaft means adjacent each bulkhead side wall; each container restraining member can have the substantially horizontal rod pivotally connected to the restraining member; and means can operatively interconnect the upwardly extending rod and the horizontal rod so that vertical displacement of the upwardly extending rod causes substantially horizontal displacement of the horizontal rod thereby rotating the restraining member from stored to operating position and vice versa.

The means operatively interconnecting the upwardly extending rod and a horizontal rod can include a substantially L-shaped member with first and second radial arms; the L-shaped member can be mounted to a bulkhead side wall to rotate about a horizontal axis; the upwardly extending rod can be pivotally joined to the first and largely horizontal arm; and the horizontal rod can be pivotally joined to the second and largely vertical arm.

The shaft means and each upwardly extending rod and horizontal rod can be located beyond the end of the car body well and lower than the bottom of a top container stacked on top of a lower container transported by the car.

The horizontal rod can be connected to the second arm and to the restraining member by ball and socket universal joints, sometimes called knuckle joints.

A latch means is included to prevent unwanted rotation of the horizontal shaft.

DETAILED DESCRIPTION OF THE DRAWINGS

To the extent it is reasonable and practical the same or similar elements which appear in the various views of the drawings will be identified by the same numbers.

Figure 1:
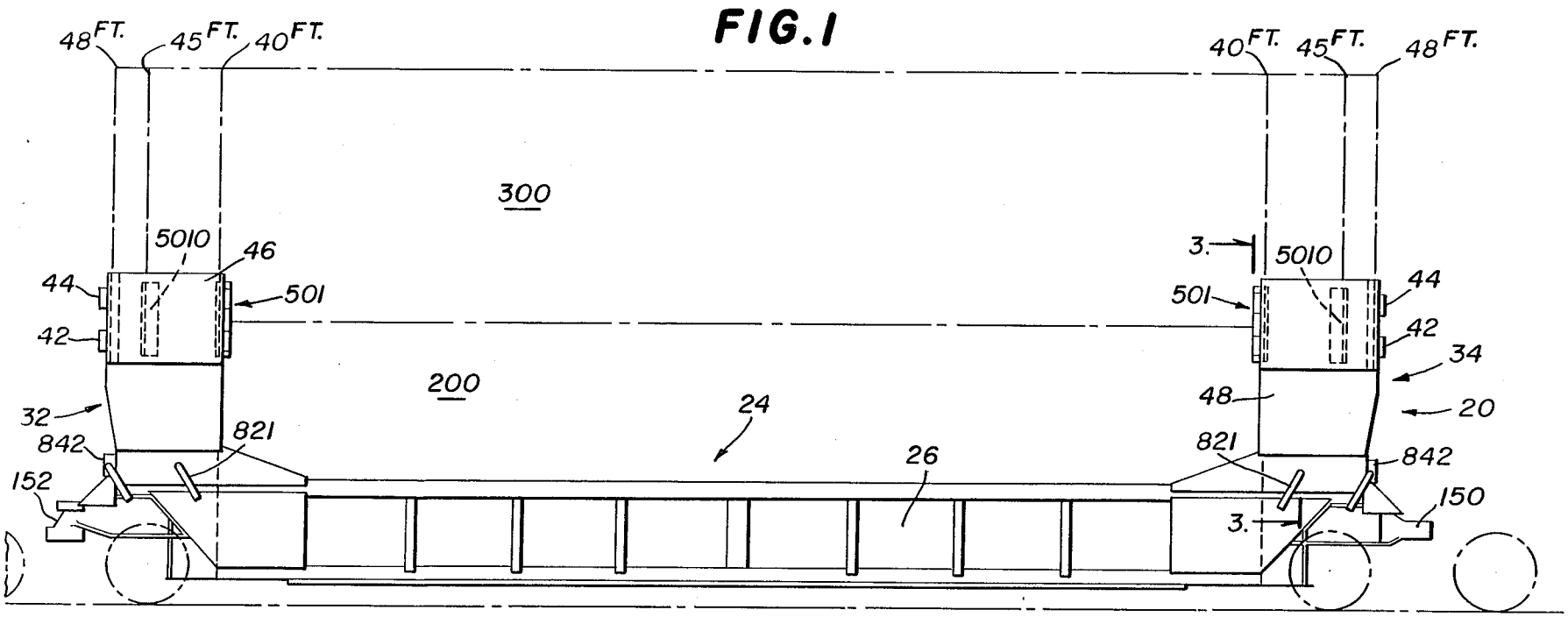
FIG. 1 is a side elevational view of a railroad car, according to the invention, for transporting horizontal double stacked shipping containers shown in phantom.
Figure 2:
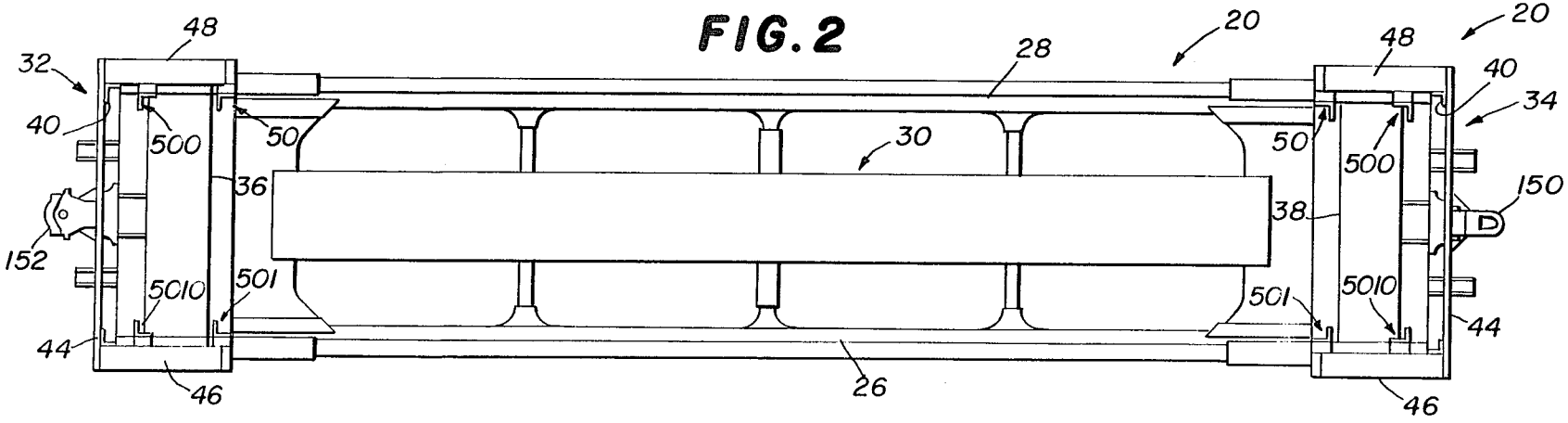
FIG. 2 is a plan view of the railroad car shown in FIG. 1.

The railroad car 20 for transporting horizontal double stacked shipping containers shown in FIGS. 1 and 2 has a body 24 comprising a pair of opposing longitudinal low vertical side walls 26,28, a bottom or floor 30 and a vertically projecting bulkhead structure 32,34 at each end of the car body. Each end of the car body is supported by a railroad car truck which may support only one car end or the car truck can support two adjacent car ends by means of an articulated coupling, such as shown in U.S. Pat. No. 3,646,604. The car shown in the drawings is provided with a male coupler portion 150 at one end and a female coupler portion 152 at the other end which on opposing ends of adjacent cars form an articulated coupling.

The lower portion of each bulkhead structure 32,34 includes a respective vertical lateral end wall 36,38 extending between the body side walls 26,28. The well space defined by the two end walls 36,38 and the two side walls 26,28 is dimensioned to hold one forty-feet long lower or bottom container which rests on corner supports (not shown) positioned on the floor 30. Alternatively, the well can support two twenty-feet long containers on suitable floor located container supports.

Each vertically projecting bulkhead structure 32,34 is essentially a mirror image of the other so only one will be described in detail. However, the same or similar parts on each of the two bulkhead structures have the same numbers for convenience and easy reference.

The bulkhead structure 34 (FIGS. 1 to 3) includes a lateral bulkhead end wall 40 comprising two horizontal spaced apart channel members 42,44 which extend the width of the car body. Also, the bulkhead structure 34 has a pair of opposing relatively short bulkhead side walls 46,48 extending longitudinally inwardly from the bulkhead end wall 40 and which are substantially aligned with the well side walls 26,28. Each bulkhead side wall 46,48 is essentially a mirror image of the other wall.

Because the top or upper container 300 placed on the lower container 200 can have the same length as the lower container, i.e. forty-feet, or be a longer standard length, i.e. forty-five or forty-eight feet (FIG. 1) it is necessary to provide retractable means to keep the shorter forty and forty-five feet containers from moving longitudinally during transport since they would not be restrained by the end walls 40, which are forty-eight feet apart, as would the largest or forty-eight feet long container. Accordingly, each bulkhead structure in the railroad car of this invention is provided with retractable means which can be moved from an operable position which restrains upper container ends to a stored position where they do not obstruct positioning a longer container between the bulkhead side walls.

Figure 3:
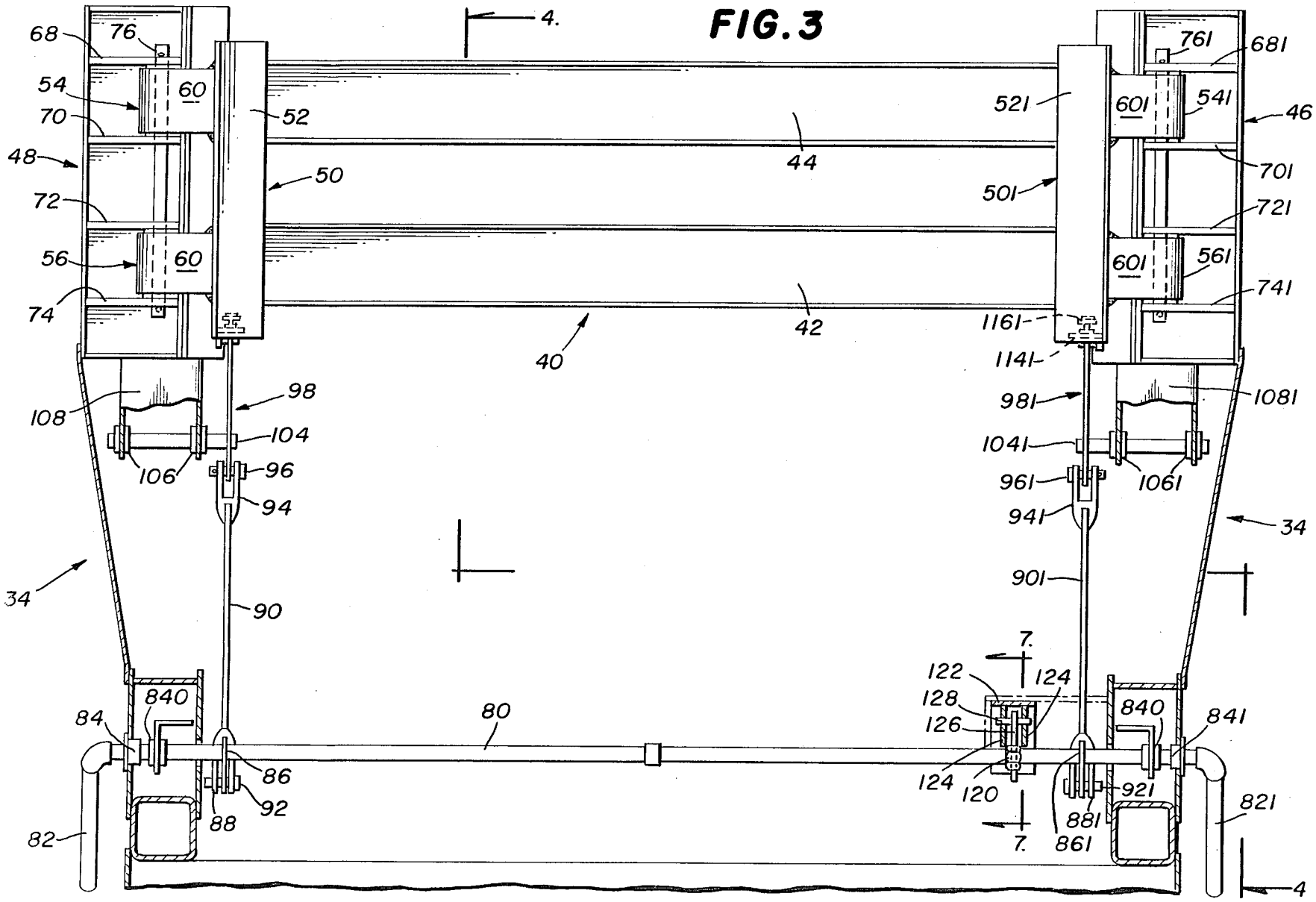
FIG. 3 is a sectional view taken along the line 3—3 of FIG. 1.
Figure 4:
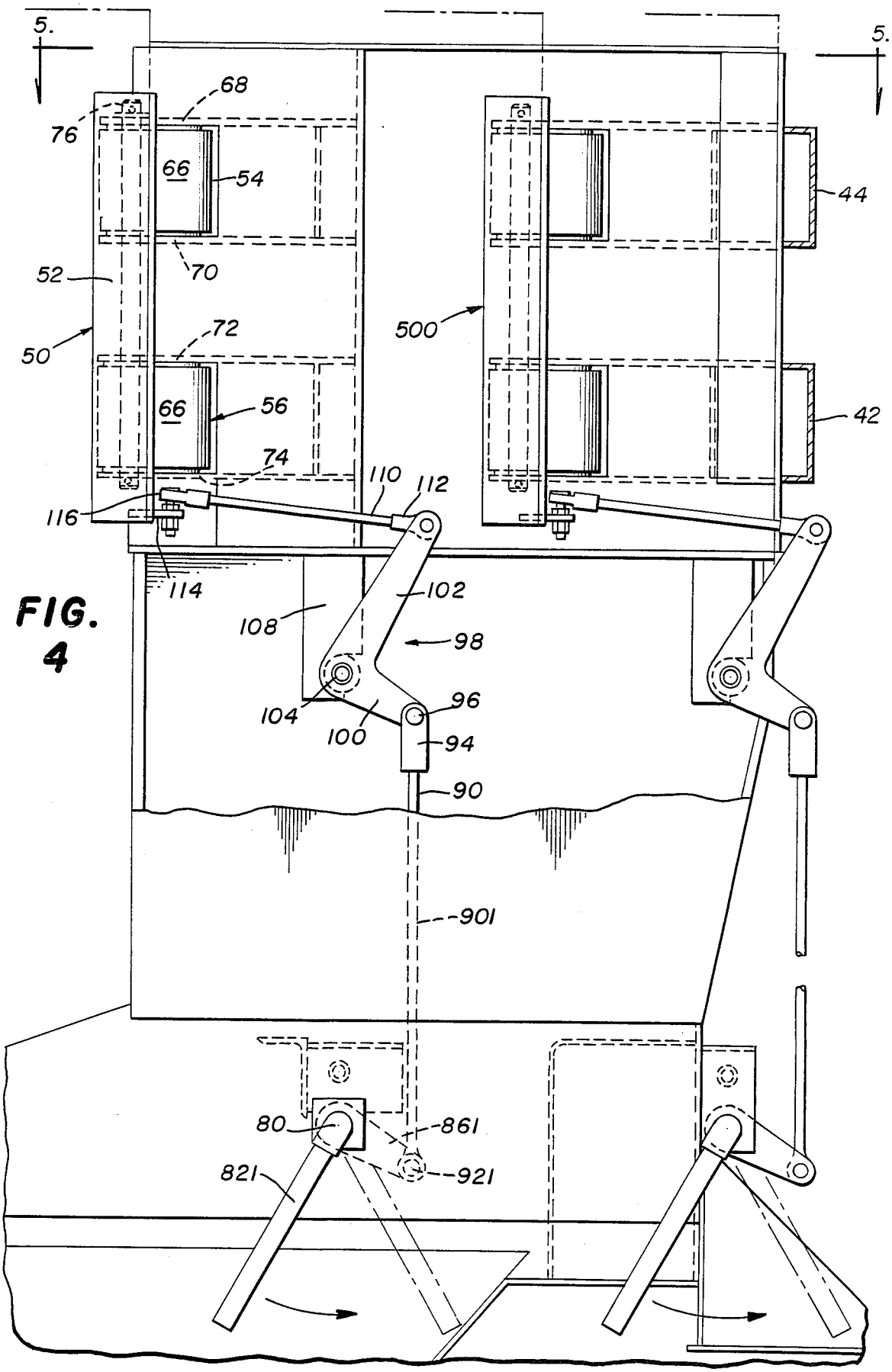
FIG. 4 is a sectional view taken along the line 4—4 of FIG. 3.

As shown in FIGS. 3 and 4, bulkhead side wall 48 has a retractable container restraining member 50 and bulkhead side wall 46 has a retractable container restraining member 501 which is a mirror image of member 50.

Figures 5, 6, 7:
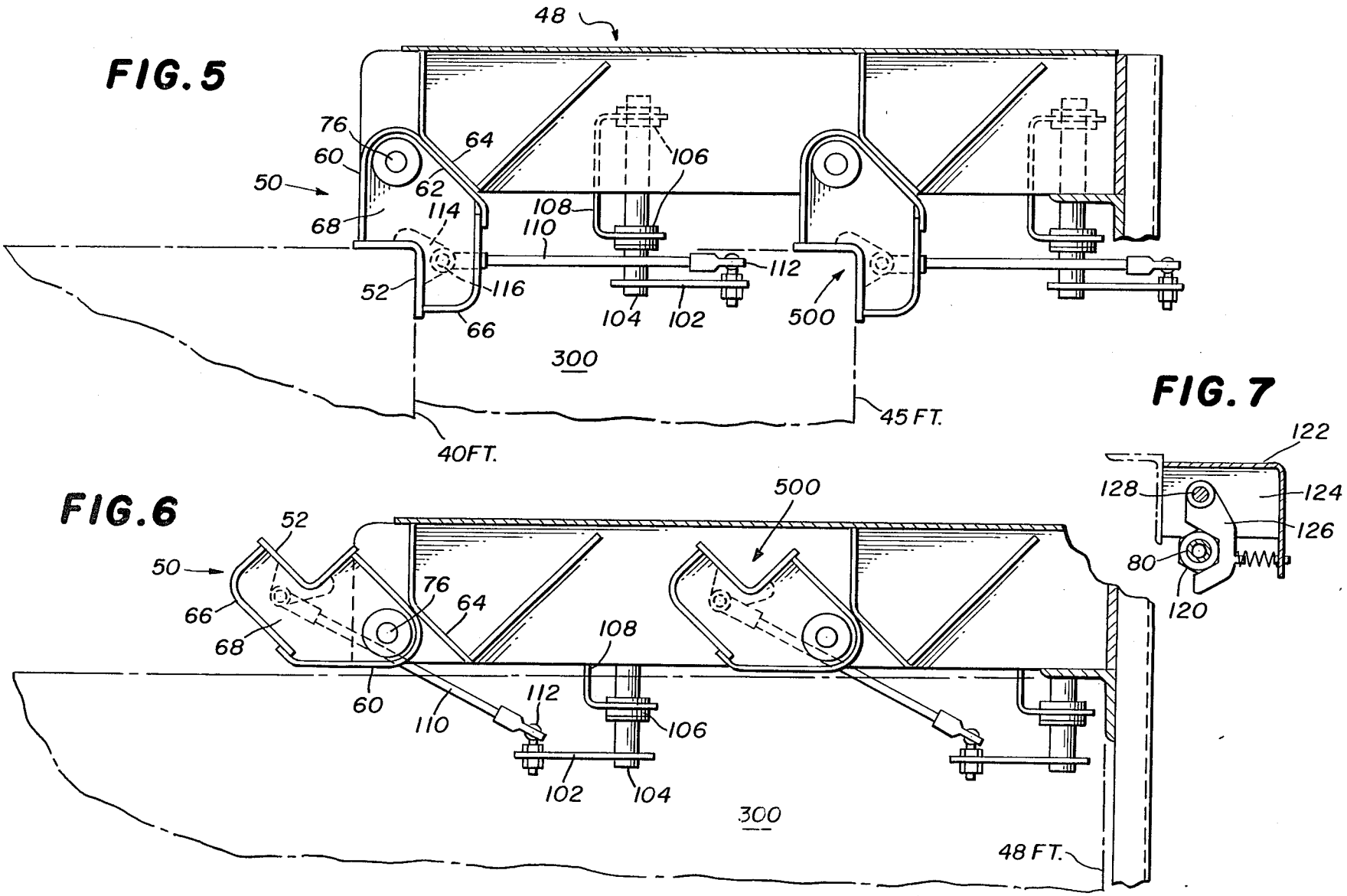
FIG. 5 is a plan view, partially in section, taken along the line 5—5 of FIG. 4 and showing the container restraining members in operating position.
FIG. 6 is similar to FIG. 5 but showing the container restraining members in stored position.
FIG. 7 is a side elevational view, partially in section, taken along the line 7—7 of FIG. 3 and showing the latch for restraining rotation of the rotatable shaft.

Restraining member 50 includes a vertically positioned angle 52 to which two hinge elements 54,56 are joined (FIGS. 3 to 5). Each hinge element 54,56 has a vertical curved plate 60 with a flat rear portion 62 which butts against a mating plate 64 mounted in wall 48 and thus provides a stop against further movement of the restraining member when in operating or open position. Each hinge element 54,56 also has a pair of spaced apart horizontally positioned plates 68 which are joined to angle 52, curved plate 60 and a further curved vertical plate 66. The bulkhead side wall 48 has a pair of vertically spaced apart but horizontal plates 68,70 and a second pair of such plates 72,74. The restraining member 50 hinge portion 54 fits between the pair of plates 68,70 and the hinge portion 56 fits between the plates 72,74. A vertical axle or pin 76 extends through plate 68 hinge portion 54, plates 70,72, hinge portion 56 and plate 74 so that the restraining member 50 can be rotated about a vertical access from operable position (FIG. 5) to stored or closed position (FIG. 6).

The restraining member 501 is retractably mounted on bulkhead side wall 46 such that it is a mirror image structural arrangement of that used to mount restraining member 50 on bulkhead side wall 48. Accordingly, those elements on bulkhead side wall 46 which are mirror images of those on wall 48 are given the number used to identify the element on wall 48 plus the number "1". Thus, element 54 on wall 48 becomes 541 on wall 46. This numbering system will be used herein for other similar elements on the different respective bulkhead side walls.

Extending laterally across the car body and through the lower portion of bulkhead side walls is a rotatable shaft 80 having handle 82 at one end and a handle 821 at the other end. The rotatable shaft 80 is located beyond the end of the well space so that it does not obstruct the well space. The shaft 80 is supported ir a bearing 84 in bulkhead side wall 48 and in bearing 841 in bulkhead side wall 46.

A lever 86 is fixedly connected to shaft 80 close to bulkhead wall 48 (FIGS. 3 and 4). A clevis 88 or the lower end of rod 90 is connected to the outer end of lever 86 by a pin 92. A clevis 94 on the upper end of rod 90 is connected to the first arm 100 of L-shaped member 98 by a pin 96.

The L-shaped member 98 is fixedly joined to horizontal axle 104 which is rotatably supported in a pair of bearings 106 supported by a bracket 108 connected to the bulkhead wall 48.

The L-shaped member 98 also has an integral second arm 102 to which one end of horizontal rod 110 is connected by a ball and socket universal or articulated joint 112. A horizontal plate 114 is joined to the rear bottom portion of angle 52. The forward end of rod 110 is connected to plate 114 by a ball and socket joint 116.

The mechanism just described is used to rotate container restraining member 50 from operating position (FIG. 5) to stored position (FIG. 6) when the handle 82 or 821 is rotated. Thus, a workman can be on either side of the car and operate the mechanism. The mechanism used to rotate the mirror image twin container restraining member 501 is also connected to shaft 80 and to member 501. That mechanism contains the same type, but mirror images, of elements used to rotate member 50 by means of shaft 80. Accordingly, the respective elements used to operate member 501 have been given the same numbers as those used to move member 50 except that the number "1" has been included at the end of the number. Because of the described mechanism, when shaft 80 is rotated the member 501 also rotates simultaneously with, but in an opposite direction than, member 50. Accordingly, both members 50,501 are moved simultaneously from stored position to operating position to be ready to secure a forty-foot double stack container in place on top of a lower forty-foot container in the well. When in operating position the angles 52,521 engage the vertical corners of the top container and the bottom container so that both containers are secured together into a unit.

When a container longer than forty-feet is to be placed on top, the restraining members 50,501 are rotated into stored position by rotating shaft 80.

Since the car embodiment of this invention as illustrated by the drawings is also intended to carry a top container having a forty-five feet length, each bulkhead structure 32,34 is provided with a second pair of container restraining members 500 and 5010. The restraining member 500 corresponds to restraining member 50, and the container restraining member 5010 corresponds to restraining member 501. Each restraining member 500 and 5010 is operatively rotated by the same type of mechanisms used to operate members 50 and 501 so it is unnecessary to describe them in detail again. However, the horizontal shaft 80 used to simultaneously operate members 500,5010 is mounted in bearings 840, located in brackets 842 joined to the rear ends of the bulkheads 32,34. The bearings 840 are not needed in the mechanisms used to rotate members 50,501, since bearings 84,841 are in themselves fully adequate.

Each shaft 80 is provided with a hexagonal member 120 mounted axially on the shaft 80 (FIGS. 3 and 7). A bracket 122 is suitably mounted to the car body above shaft 80. Vertical plate 124 is mounted to bracket 122 and to the car body above shaft 80. A latch in the form of a vertical arm 126 is mounted between two vertical plates 124 by pin 128. The arm 126 has a cut-out portion which corresponds to three adjacent sides of the hexagonal member 120 thereby permitting the cut-out portion to closely mate with member 120 on three sides. A compression spring between arm 126 and an adjoining portion of bracket 122 keeps the arm 126 firmly against hexagonal member 120. The shaft is thus prevented from unwanted rotation when the container members are in stored or operating position. However, when a workman applies a force to the handle 82 or 821 the locking action of arm 126 is readily overcome and shaft 80 rotates easily even though the ratcheting action of arm 126 continues so long as shaft 80 rotates.

The foregoing detailed description has been given for clearness of understanding only, and no unnecessary limitations should be understood therefrom, as modifications will be obvious to those skilled in the art.

What is claimed is:

1. A railroad car for transporting horizontal double stacked shipping containers capable of supporting top containers of at least two different lengths against longitudinal and lateral movement comprising:

first and second railroad trucks supporting opposite ends of a railroad car body;

the car body having means which supports one or more horizontal longitudinally positioned lower containers;

each end of the car body having a vertically projecting bulkhead structure which includes a lateral bulkhead end wall extending the width of the car body and a pair of opposing relatively short bulkhead side walls extending longitudinally inwardly from the bulkhead end wall along the sides of the car body;

each bulkhead side wall of a pair of such walls having a container restraining member mounted on an axle for rotation about a substantially vertical axis from a stored position where it does not reduce the clearance between opposing bulkhead side walls to an operating position where it at least projects laterally inwardly of the bulkhead wall to be positioned adjacent a vertical end corner of a top container;

a rotatable shaft means extending laterally across the car body and having a handle at each end fcr manual rotation of the shaft means from about track grade; and drive means interconnecting the shaft means and a container restraining member on each bulkhead side wall whereby rotation of the shaft means in one direction causes the restraining members to rotate in opposite directions from stored to operating position and rotation of the shaft means in the opposite direction causes the restraining members to rotate in opposite directions from operating to stored position.

2. A railroad car for transporting horizontal double stacked shipping containers capable of supporting top containers of at least two different lengths against longitudinal and lateral movement comprising:

first and second railroad trucks supporting opposite ends of a railroad car body;

the car body having a well portion, defined in part by low side walls, which supports one or more horizontal longitudinally positioned lower containers;

each end of the car body having a vertically projecting bulkhead structure which includes a lateral bulkhead end wall extending the width of the car body and a pair of opposing relatively short bulkhead side walls extending longitudinally inwardly from the bulkhead end wall and substantially aligned with the well side walls;

each bulkhead side wall of a pair of such walls having a container restraining member mounted on an axle for rotation about a vertical axis from a stored position where it does not reduce the clearance between opposing bulkhead side walls to an operating position where it at least projects laterally inwardly of the bulkhead wall to be positioned adjacent a vertical end corner of a top container; tainer;

a rotatable shaft means extending laterally across the car body and having a handle at each end for manual rotation of the shaft means from about track grade;

an upwardly extending rod;

means operatively interlocking the upwardly extending rod and the shaft means adjacent each bulkhead side wall; and means operatively interlocking the upwardly extending rod and a container restraining member;

whereby rotation of the shaft means in one direction causes the restraining members to rotate in opposite directions from stored to operating position and rotation of the shaft means in the opposite direction causes the restraining members to rotate in opposite directions from operating to stored position.

3. A railroad car for transporting horizontal double stacked shipping containers capable of supporting top containers of at least two different lengths against longitudinal and lateral movement comprising:

first and second railroad trucks supporting opposite ends of a railroad car body;

the car body having a well portion, defined in part by low side walls, which supports one or more horizontal longitudinally positioned lower containers;

each end of the car body having a vertically projecting bulkhead structure which includes a lateral bulkhead end wall extending the width of the car body and a pair of opposing relatively short bulkhead side walls extending longitudinally inwardly from the bulkhead end wall and substantially aligned with the well side walls;

each bulkhead side wall of a pair of such walls having a container restraining member mounted on an axle for rotation about a vertical axis from a stored position where it does not reduce the clearance between opposing bulkhead side walls to an operating position where it at least projects laterally inwardly of the bulkhead wall to be positioned adjacent a vertical end corner of a top container;

a rotatable shaft means extending laterally across the car body and having a handle at each end for manual rotation of the shaft means from about track grade;

an upwardly extending rod pivotally connected at the lower end to a lever on the shaft means adjacent each bulkhead side wall;

each container restraining member having a substantially horizontal rod pivotally connected to the restraining member; and means operatively interconnecting an upwardly extending rod and a horizontal rod so that vertical displacement of the upwardly extending rod causes substantially horizontal displacement of the horizontal rod thereby rotating the restraining member from stored to operating position and vice versa.

4. A railroad car according to claim 3 in which the means operatively interconnecting an upwardly extending rod and a horizontal rod includes:

a substantially L-shaped member with first and second radial arms;

the L-shaped member being mounted to a bulkhead side wall to rotate about a horizontal axis;

the upwardly extending rod being pivotally joined to the first and largely horizontal arm; and the horizontal rod being pivotally joined to the second and largely vertical arm.

5. A railroad car according to claim 3 in which the shaft means and each upwardly extending rod and horizontal rod are located beyond the end of the car body well and lower than the bottom of a top container stacked on top of a lower container transported by the car.

6. A railroad car according to claim 4 in which the horizontal rod is connected to the second arm and to the restraining member by ball and socket universal joints.

7. A railroad car according to claim 3 including latch means to restrain the rotatable shaft means against unwanted rotation.

8. A railroad car according to claim 7 in which the latch means to restrain the rotatable shaft means against unwanted rotation is a ratchet means.

* * * * *

UNITED STATES PATENT AND TRADEMARK OFFICE

CERTIFICATE OF CORRECTION

PATENT NO. : 4,759,294

DATED : July 26, 1988

INVENTOR(S) : JAMES J. SCHULLER ET AL

It is certified that error appears in the above-identified patent and that said Letters Patent is hereby corrected as shown below:

Column 4, line 63, change "ir" to -- in --; line 67, change "or" to -- on --; column 7, line 8, delete "tainer;".

Signed and Sealed this

Twenty-ninth Day of November, 1988

*Attest:*

DONALD J. QUIGG

*Attesting Officer*

*Commissioner of Patents and Trademarks*